US006427924B2

(12) United States Patent
Takagi et al.

(10) Patent No.: US 6,427,924 B2
(45) Date of Patent: Aug. 6, 2002

(54) COMBUSTION TYPE HEATER

(75) Inventors: Masashi Takagi; Masakazu Ozaki, both of Kariya; Hirohito Matsui, Nishio; Sadahisa Onimaru, Nishio; Yuichi Sakajo, Nishio; Toshio Morikawa, Toyota; Kouji Mori, Nagoya, all of (JP)

(73) Assignees: Denso Corporation, Kariya; Nippon Soken, Inc., Nishio, both of (JP)

( * ) Notice: Subject to any disclaimer, the term of this patent is extended or adjusted under 35 U.S.C. 154(b) by 0 days.

(21) Appl. No.: 09/843,658

(22) Filed: Apr. 26, 2001

(30) Foreign Application Priority Data

Apr. 27, 2000 (JP) ..... 2000-132891
Oct. 4, 2000 (JP) ..... 2000-305444

(51) Int. Cl.[7] ..... B60H 1/02

(52) U.S. Cl. ..... 237/12.3 C; 431/326; 431/330

(58) Field of Search ..... 237/12.3 C, 12.3 R; 165/41, 43; 123/142.5 R; 239/135, 548, 552, 556, 566, 567; 431/330, 326, 298

(56) References Cited

U.S. PATENT DOCUMENTS 1,387,799 A * 8/1921 Mills ..... 431/328
3,653,796 A * 4/1972 Kercher et al. ..... 431/328
4,538,985 A * 9/1985 Zwicker ..... 431/262
4,934,924 A * 6/1990 Nakai ..... 431/41
5,090,896 A * 2/1992 Kenner et al. ..... 431/262
5,218,952 A * 6/1993 Neufeldt ..... 126/92
5,617,995 A * 4/1997 Yasuda et al. ..... 237/12.3 C
5,632,443 A * 5/1997 Quarrie ..... 237/12.3 C
5,722,588 A * 3/1998 Inoue et al. ..... 237/12.3 C

FOREIGN PATENT DOCUMENTS

JP 6-16112 U 3/1994
JP 7-215043 8/1995

* cited by examiner

*Primary Examiner*—Harold Joyce
*Assistant Examiner*—Derek S. Boles
(74) *Attorney, Agent, or Firm*—Harness, Dickey & Pierce, PLC

(57) ABSTRACT

A combustion type heater of this invention includes fuel distribution means 11 for distributing a fuel to the whole surface of a wick 10, disposed upstream of the wick in a fuel passage. The fuel distribution means comprises fuel distribution grooves 15 and a fuel dispersion plate 16 having a large number of holes bored therein. The fuel distribution means can quickly supply the fuel to the whole surface of the wick. To shorten the heating time of the wick, the heater of the present invention uses a wick heating glow plug 14*b* outside an ignition glow plug 14*a*, or a planar heater 18, for heating the wick.

9 Claims, 15 Drawing Sheets

A-A SECTION

DIFFUSION STATE OF FUEL

COMBUSTION TYPE HEATER

BACKGROUND OF THE INVENTION

1. Field of the Invention

This invention relates to a combustion type heater, for vehicles, that is used for heating the inside of vehicles such as cars.

2. Description of the Related Art

Combustion type heaters for vehicles, used for heating the inside of the vehicles, generally employ the following construction. A blower driven by a motor introduces combustion air into a combustion chamber, and a fuel pump supplies a fuel into the combustion chamber. Air and the fuel are mixed inside the combustion chamber to create an air-fuel mixture. A glow plug ignites the air-fuel mixture. The resulting combustion heat heats flowing air or water, and the air or the water so heated, in turn, heats the inside of the car.

A heat exchanger for a car heater described in Japanese Unexamined Utility Model Publication (Kokai) No. 6-16112 is known as a combustion type heater for a vehicle of the type described above. As shown in FIG. 15 of the accompanying drawings, the heat exchanger 1 for a heater of a car (combustion type heater) includes therein an air chamber 2 for passing combustion air and a combustion chamber 3 for burning an air-fuel mixture. The heat exchanger 1 further includes, inside the air chamber 2, a motor 4 and a blower 5, for the combustion air, rotated by the motor 4. When the motor 4 drives the blower 5, air is introduced into the combustion chamber 3 through an air passage 2-1. A glow plug 6, the distal end of which protrudes into the combustion chamber 3, is. fitted to an outer wall of the heat exchanger 1. A fluid passage 7 through which a fluid for heat exchange flows is disposed inside the outer wall. A fuel pump 8 is disposed separately from the heat exchanger 1. Fuel piping 9 is disposed in such a manner as to extend from the fuel pump 8 to the combustion chamber 3. A planar wick 10 is disposed at a bottom 12 of the combustion chamber 3 and is connected to the distal end of the fuel piping 9.

The fuel sent from the fuel pump 8 is diffused by the wick 10, and is mixed with combustion air blown by the blower 5 to create the air-fuel mixture. The glow plug 6 ignites and burns this air-fuel mixture.

In the conventional heat exchanger 1 for the car heater described above, the fuel piping 9 is positioned at the center of the planar wick 10, and the fuel is supplied from the center part of the wick 10. According to this method, however, the fuel sinks into the wick 10 from the center and gradually diffuses to the whole part as typically shown in FIG. 16. Therefore, it takes time for the fuel to evaporate from the wick as a whole, and the rise time of the operation of the heat exchanger for the car heat is retarded.

In this heat exchanger for the car heater according to the prior art, the fuel distribution in the wick is dense at the center and is leaner towards the ends even during steady combustion, generating thereby non-uniformity in fuel evaporation. When the feed amount of the fuel is great, the fuel sometimes scatters while flowing through the wick.

In this conventional heat exchanger for the car heater, only one glow plug 6 is disposed in the proximity of the planar wick 10. The wick is heated by the radiation energy of the glow plug to evaporate the fuel, and the evaporated fuel is ignited by the glow plug. Moreover, the glow plug 6 is inserted into the combustion chamber 3 while penetrating through the combustion gas passage. According to this arrangement of the glow plug, about a half of the radiation energy of the glow plug is lost, a long time is necessary for the fuel to evaporate% from the wick, and the start of the operation of the heat exchanger for the car heater is retarded.

In the conventional combustion type heater described above, the combustion chamber is disposed in the longitudinal direction. A combustion type heater wherein the combustion chamber is disposed in the transverse direction is also known as described, for example, in Japanese Unexamined Patent Publication (Kokai) No. 7-215043. In this conventional combustion type heater 1 for vehicles wherein the combustion chamber 3 is disposed transversely (see FIG. 17), the fuel supplied from the fuel piping 9 to the wick 10 as an evaporation plate diffuses through the wick 10 as a whole due to capillary action. However, the fuel that cannot fully evaporate drops gradually to the lower part of the wick 10 due to gravity. In consequence, the fuel density is high at the lower part of the wick and the fuel forms a pool. In an extreme case, the pooled fuel flows out into the combustion chamber of the combustion cylinder. When the fuel pool is generated, the pooled fuel gradually permeates and diffuses into the wick and evaporates after put-off of the heater, and is likely to be discharged while it remains as the unevaporated fuel. When the fuel flows out into the combustion chamber, the air-fuel ratio becomes rich during combustion, thereby inviting deterioration of exhaust emission.

To solve these problems, the combustion type heater 1 disclosed in Japanese Unexamined Patent Publication (Kokai.) No. 7-215043 employs the-construction wherein the wick 10 is extended inside the combustion chamber at its lowermost outer peripheral edge as shown in FIG. 17. According to this construction, the extension part lOa of the wick 10 receives radiation heat and is always heated by the flame of the combustion chamber 3, and its heat is transferred to the fuel gathering at the lowermost position. Therefore, even when the fuel, that sinks into the wick 10 but cannot fully evaporate, sinks due, to gravity and gathers at the lowermost position of the wick 10, its evaporation is promoted, the occurrence of the fuel pool can be prevented, and discharge of the non-burnt fuel and deterioration of exhaust emission can be avoided.

In the conventional combustion heater described above, however, evaporation of the fuel at the lowermost position of the wick 10, that is, the fuel pooled at the lowermost part of the combustion chamber, is promoted. Therefore, mixing of the fuel and combustion air does not become uniform between the upper and lower portions of the combustion chamber 3, and the evaporated fuel becomes rich at the lower portion. Consequently, complete combustion is not attained at the lower portion of the combustion chamber, so that soot is generated and exhaust emission gets deteriorated. Furthermore, the fuel does not diffuse through the wick as a whole due to the influence of gravity but a greater amount flows towards the lower portion. Thus, there are other problems in that a long time is necessary for the fuel to evaporate from the wick and the start of the operation of the combustion type heater is retarded.

SUMMARY OF THE INVENTION

In view of the problems described above, it is an object of the present invention to shorten a diffusion time of a fuel to the entire part of a wick as well as a heating time of the wick itself, and to quickly activate a combustion type heater.

It is another object of the present invention to prevent the occurrence of a fuel pool at the lowermost position of a wick, to make uniform a mixing ratio between an evaporated fuel and combustion air throughout a combustion chamber, and to improve the exhaust emission.

According to one aspect of the present invention, there is provided a combustion type heater including fuel distribution means for dispersing a supplied fuel to the whole surface of a wick. After the start of the supply of the fuel, the fuel is quickly supplied to the whole surface of the wick, combustion starts occurring from the whole surface of the wick immediately after ignition, and the start of the operation of the combustion type heater can be earlier.

According to another aspect of the present invention, there is provided a combustion type heater including a glow plug for ignition, disposed in the proximity of a front surface of a wick, and a glow plug for heating the wick, so disposed as to keep contact with the wick. The energy of the glow plugs can be utilized effectively for heating the wick, the wick can be quickly heated as a whole, and combustion quickly takes place from the whole surface of the wick.

According to still another aspect of the present invention, there is provided a combustion type heater including a planar heater for heating a wick, so disposed as to keep contact with the wick. The wick can be efficiently heated as a whole, the fuel quickly evaporates from the whole surface of the wick, and combustion starts occurring from the whole surface of the wick.

According to still another aspect of the present invention, there is provided a combustion type heater including a wick so disposed as to keep contact with a bottom surface of a combustion chamber, and a ring-like groove defined in the bottom surface of the combustion chamber in such a manner as to encompass a fuel feed port formed in the bottom surface of the combustion chamber. Even when the combustion chamber is arranged transversely, this construction can prevent the fuel from pooling at a lower part of the combustion chamber as the lowermost position of the wick due to the influence of gravity, and the fuel can spread substantially uniformly over the entire wick. In consequence, the combustion proceeds satisfactorily, deterioration of exhaust emission can be prevented, and the start of the operation of the combustion type heater can be improved.

The present invention may be more fully understood from the description of preferred embodiments of the invention, as set forth below, together with the accompanying drawings.

DESCRIPTION OF THE PREFERRED EMBODIMENTS

Figure 15:
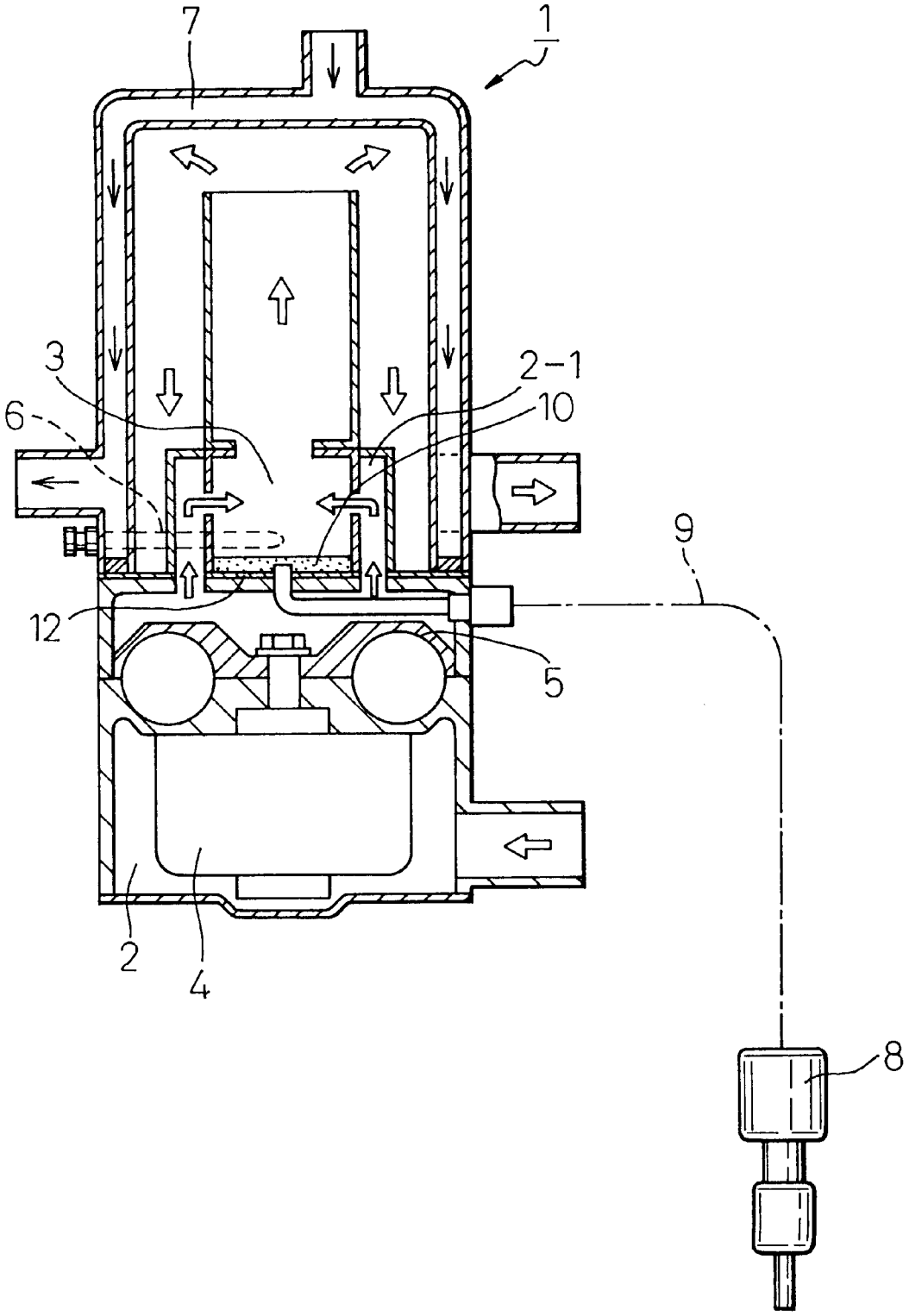
Fig.15 PRIOR ART
FIG. 15 is a sectional view showing an overall construction of a combustion type heater according to the prior art wherein a combustion chamber is disposed in a longitudinal direction.
Figure 16:
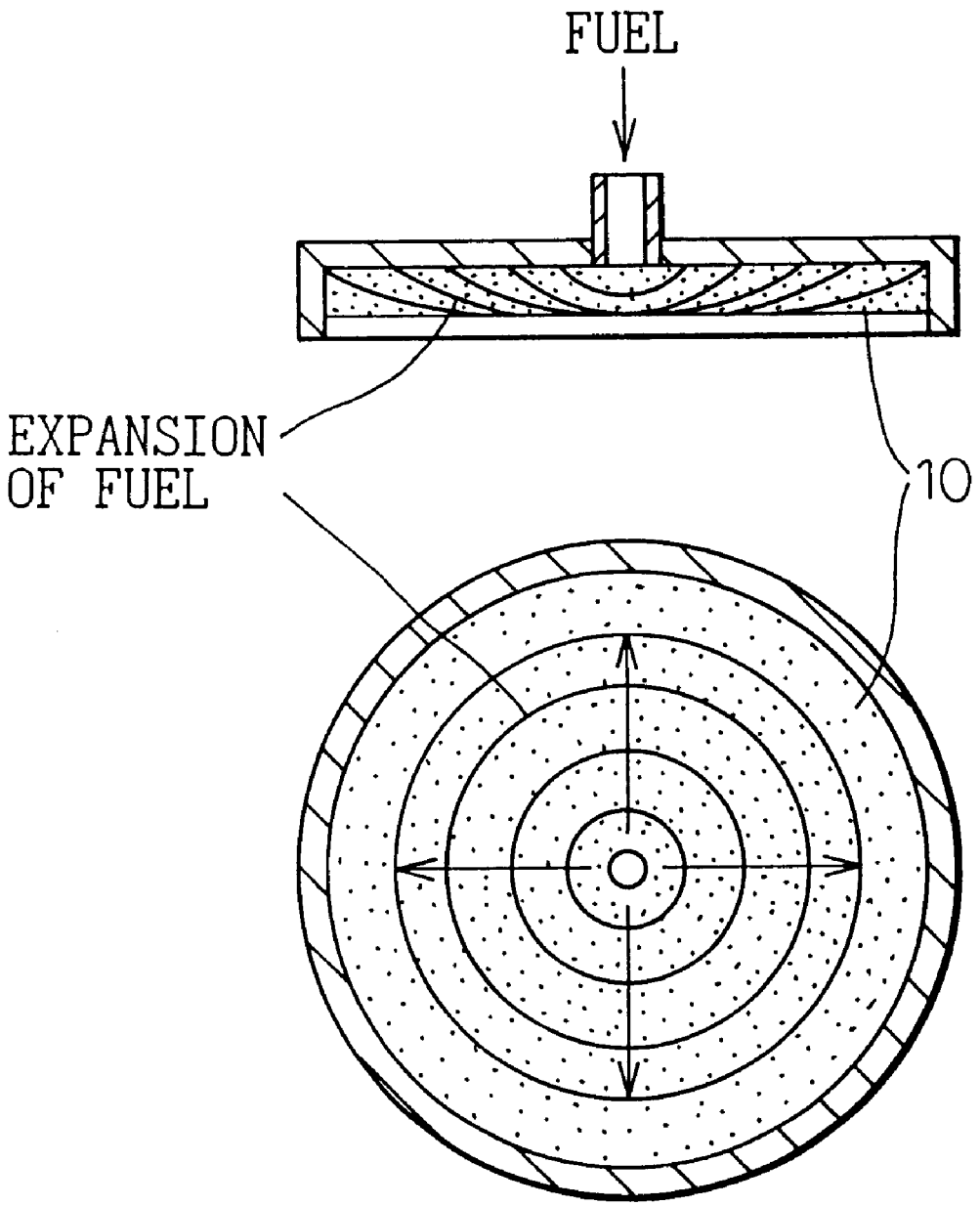
FIG. 16 is a schematic view showing a mode of expansion of the fuel inside the wick of the conventional combustion type heater shown in FIG. 15.
Figure 17:
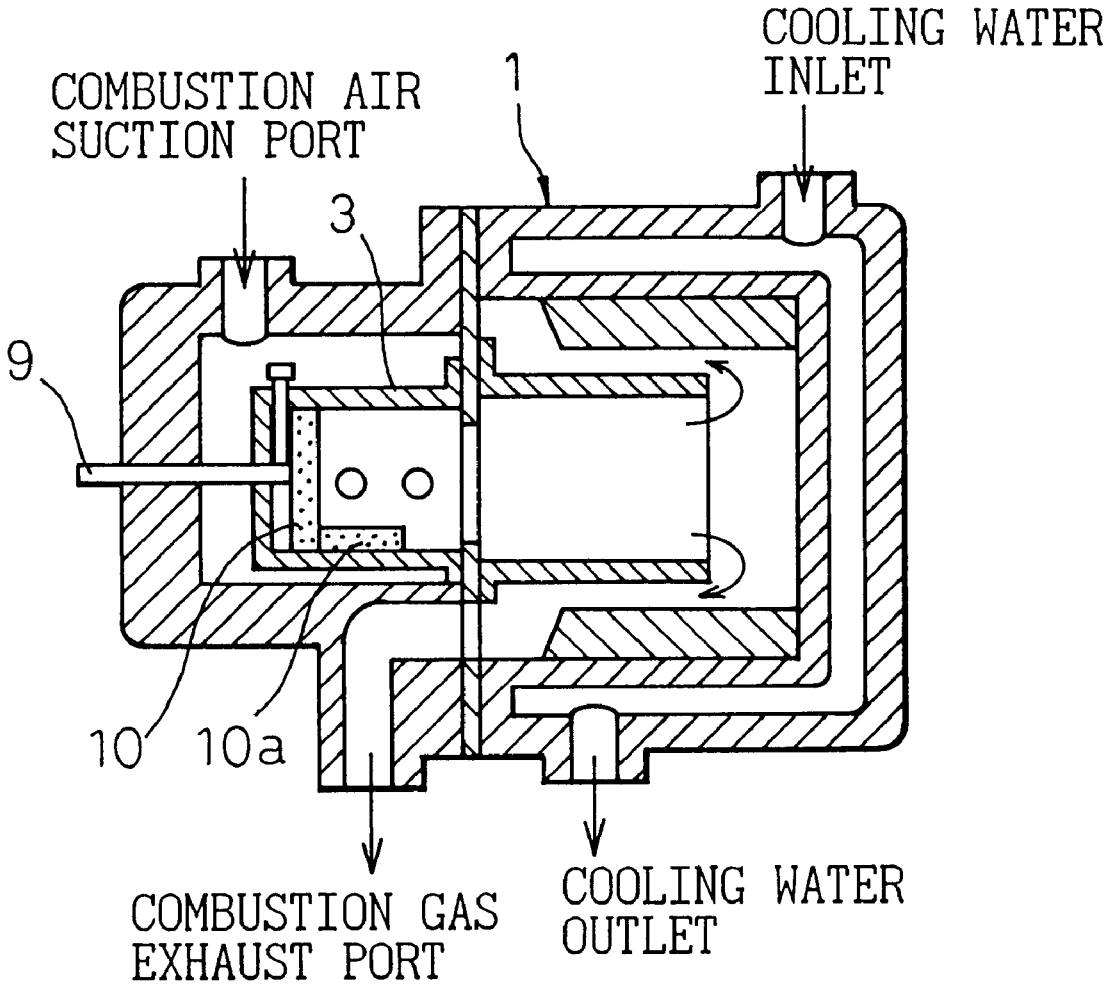
Fig.17 PRIOR ART
FIG. 17 is a sectional view showing an overall construction of a combustion type heater according to the prior art wherein a combustion chamber is disposed in a transverse direction.

Combustion type heaters according to preferred embodiments of the present invention are hereinafter explained. Incidentally, the constructions of the air feed mechanism, the fuel feed mechanism and the heat exchanger part are fundamentally the same as those of the combustion type heater shown in FIG. 15, and explanations will be omitted.

Figure 1:
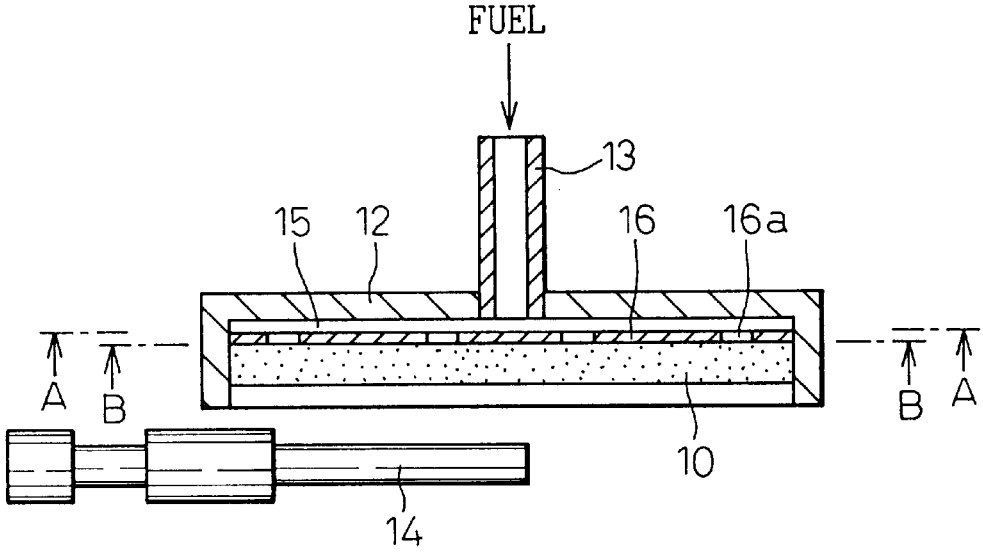
FIG. 1 is a schematic sectional view useful for explaining fuel distribution means disposed on the fuel supply side of a wick in the first embodiment of the present invention.
Figure 2A:
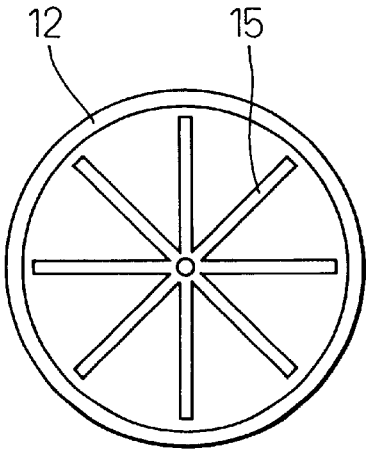
FIG. 2A is a sectional view taken along a line A—A in FIG. 1.
Figure 2B:
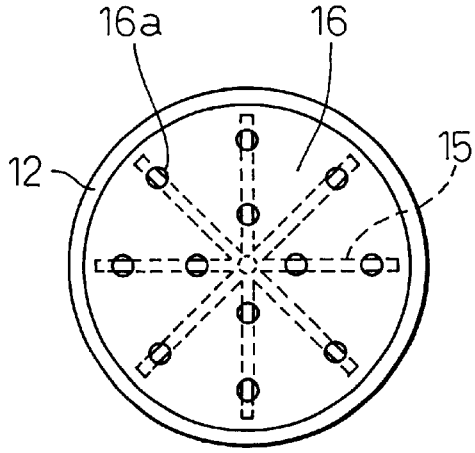
FIG. 2B is a sectional view taken along a line B—B in FIG. 1.

Referring initially to FIG. 1, a casing 12 for holding a wick 10 is shown disposed inside a combustion chamber of the combustion type heater according to the present invention. This casing 12 has a cylindrical shape, for example, and its front surface is open. The casing 12 is connected at a substantial center of its bottom surface to a fuel piping 13. An ignition glow plug 14 is disposed in the proximity of the front surface of the wick 10.

The first embodiment of the present invention includes fuel distribution means 11 for supplying the fuel from the fuel piping 13 to the entire part of the wick 10. The fuel distribution means 11 comprises fuel distribution grooves 15 that are formed in the inner surface of the bottom of the casing 12 and extend substantially radially from the center, and a fuel dispersion plate 16 having a large number of holes 16*a* bored to correspond to the fuel distribution grooves 15. The fuel supplied from the fuel piping 13 connected to the bottom center of the casing 12 first passes through the fuel distribution grooves 15, then through the holes 16*a* of the fuel dispersion plate 16 and thereafter flows into the wick 10. Since the fuel distribution means is disposed, the fuel quickly spreads on the entire surface of the wick 10 immediately after the start of supplying the fuel, and combustion starts immediately from the entire surface of the wick 10 after ignition.

Even when the fuel feed amount is large, the fuel dispersion plate 16 prevents the fuel from flowing through from the wick 10 or from scattering.

The second embodiment of the present invention uses a plurality of glow plugs 4 as shown in FIGS. 3 to 7. These glow plugs are divided into the plug 14*a* for ignition and the plugs 14*b* for heating the wick. The ignition glow plug 14*a* is disposed in the proximity of the front surface of the wick 10 and the remaining glow plugs 14*b* for heating the wick are so disposed as to keep contact with the wick 10. In this case, a single or a plurality of glow plugs 14*b* for heating the wick 10 may be used, and the remaining plugs are used for ignition. The examples shown in FIGS. 3 and 4 use one glow plug 14*a* for ignition and two glow plugs 14*b* for heating the wick 10. The number of the glow plugs can be selected appropriately.

Figure 3:
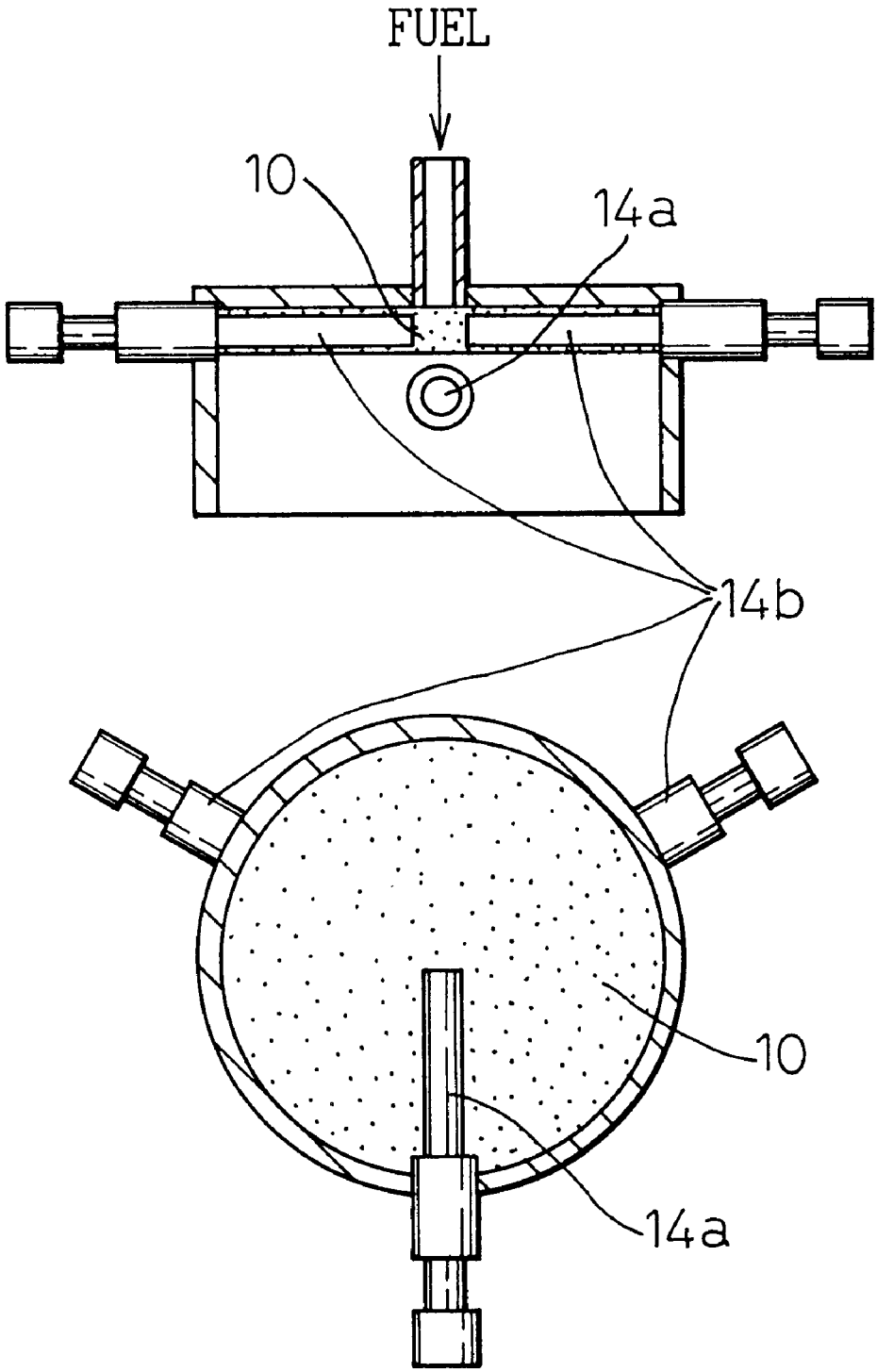
FIG. 3 is a schematic view showing a form where a glow plug for heating a wick is disposed according to the second embodiment of the present invention.
Figure 4:
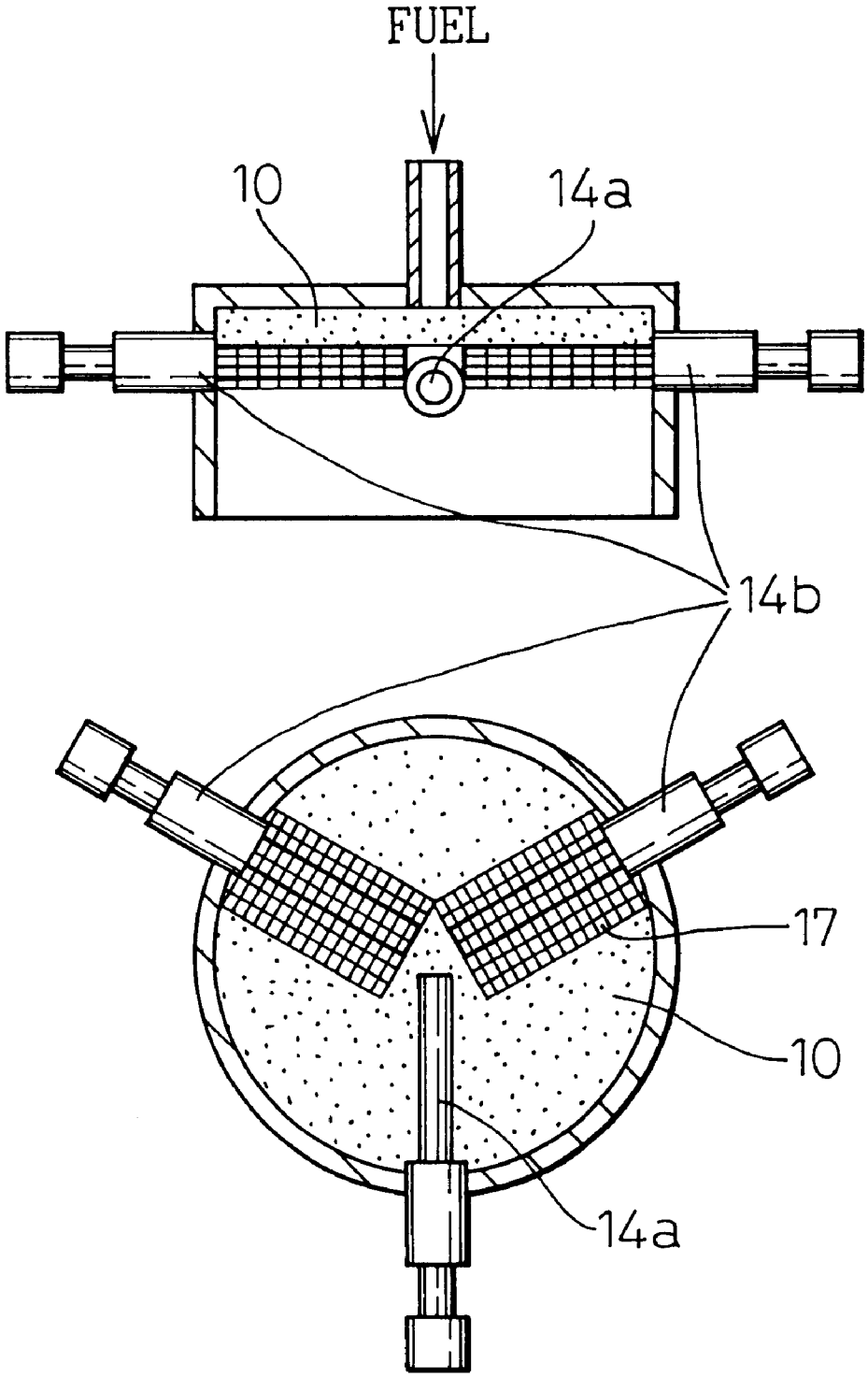
FIG. 4 is a schematic view showing another form where a heat transfer member is provided to the glow plug for heating the wick according to the second embodiment of the present invention.

The glow plug 14*b* for heating may be buried into the wick 10 as shown in FIG. 3 or may be so disposed as to keep contact with the surface of the wick 10 as shown in FIG. 4.

Furthermore, a heat transfer member 17 may be disposed in such a manner as to cover each glow plug 14*b* for heating the wick as shown in FIG. 4. The heat transfer member 17 comprises a plate, a metal net, a coil, or the like, and at least a part of the heat transfer member 17 is brought into contact with the wick 10.

Figure 5:
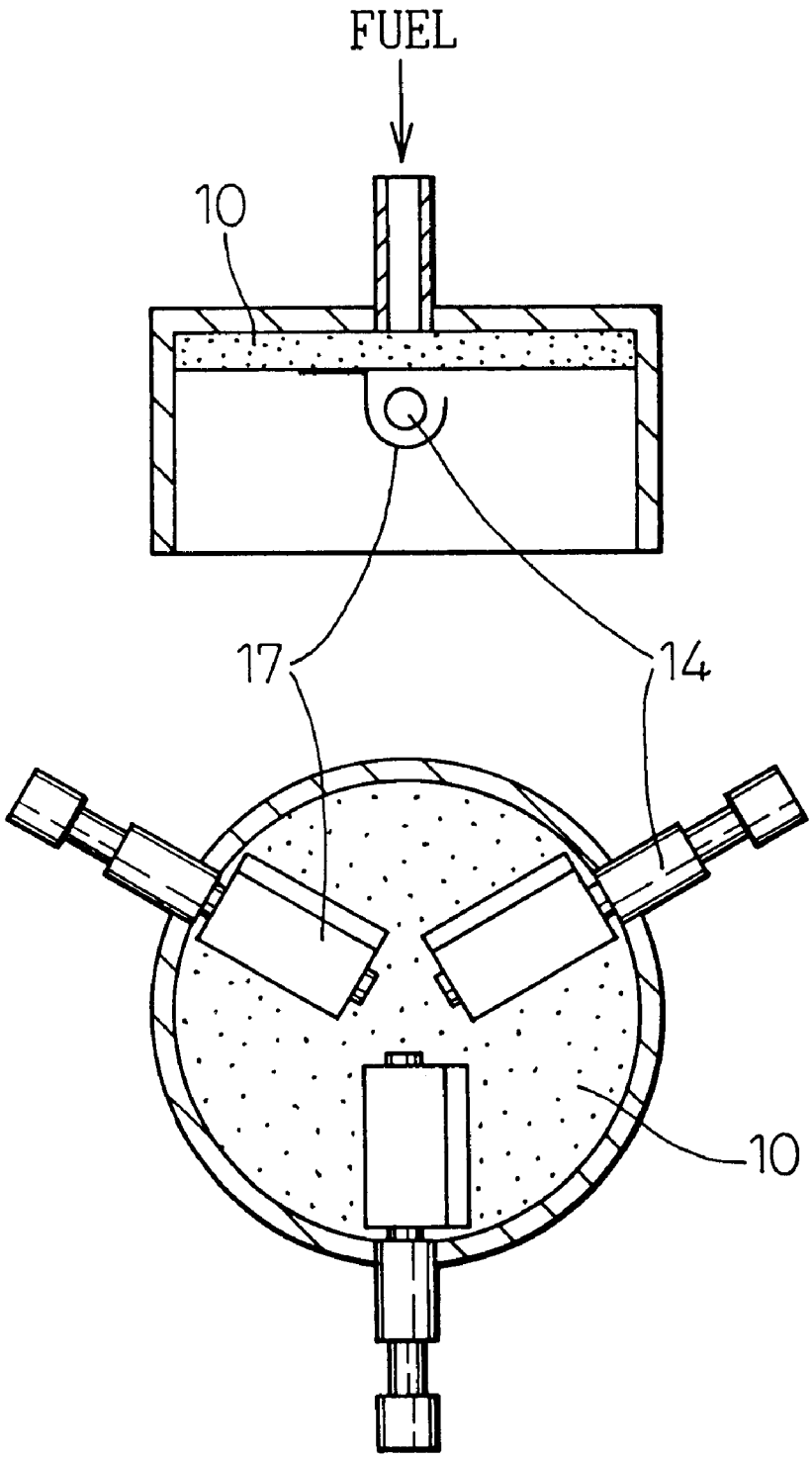
FIG. 5 is a schematic view showing a modified embodiment of the second embodiment of the present invention.
Figure 6:
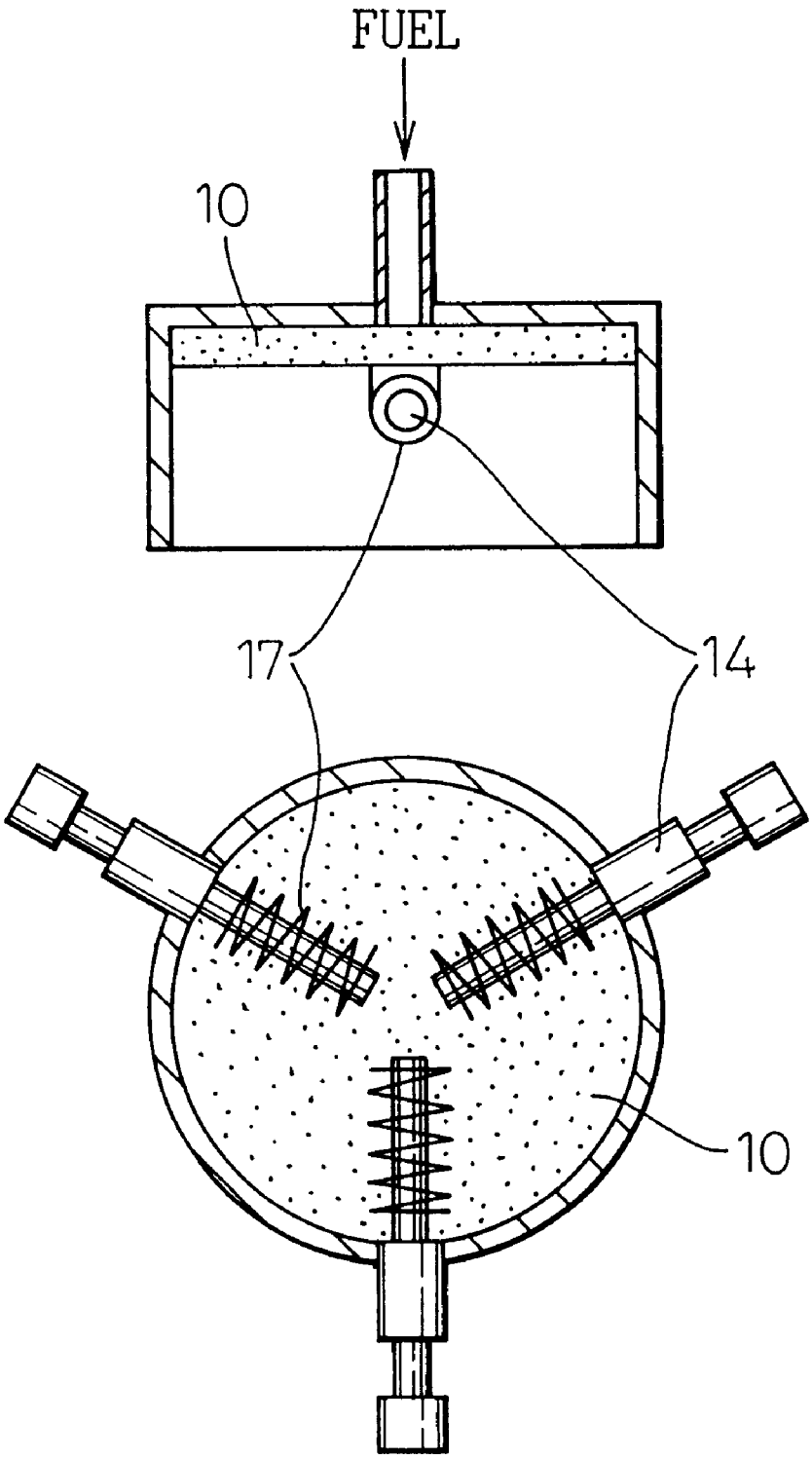
FIG. 6 is a schematic view showing another modified embodiment of the second embodiment.

FIGS. 5 and 6 show modified embodiments of the second embodiment of the present invention. A plurality (three, in FIGS. 5 and 6) of glow plugs 14 is disposed as glow plugs for ignition in the proximity of the front surface of the wick 10. To cover each glow plug 14, a heat transfer plate 17 is disposed as the heat transfer member 17 in FIG. 5 and a heat transfer coil, in FIG. 6. At least a part of each heat transfer member 17 is brought into contact with the wick 10. Each heat transfer member 17 (heat transfer plate or heat transfer coil) receives heat energy radiated from these glow plugs 14 to the side opposite to the wick 10 and transfers this energy to the wick 10 by heat conduction. Consequently, radiation energy of the glow plugs 14 can be effectively utilized for heating the wick 10. In this way, the glow plugs 14 shown in FIGS. 5 and 6 serve as the ignition glow plugs and also as the wick heating glow plugs.

In the second embodiment of the present invention, the glow plugs for heating the wick are disposed as described above. Therefore, radiation energy of the glow plugs for ignition evaporates the fuel from the wick in the proximity of the ignition glow plugs. Even when the fuel gas is ignited, the heat of the heating glow plug quickly heats the wick as a whole, and the evaporated gas is generated from the whole surface of the wick, bringing the combustion of the whole surface of the wick. Since the heat transfer member is disposed in such a manner as to cover each glow plug, radiation energy of the glow plugs can be utilized further effectively for heating the wick.

Figure 7:
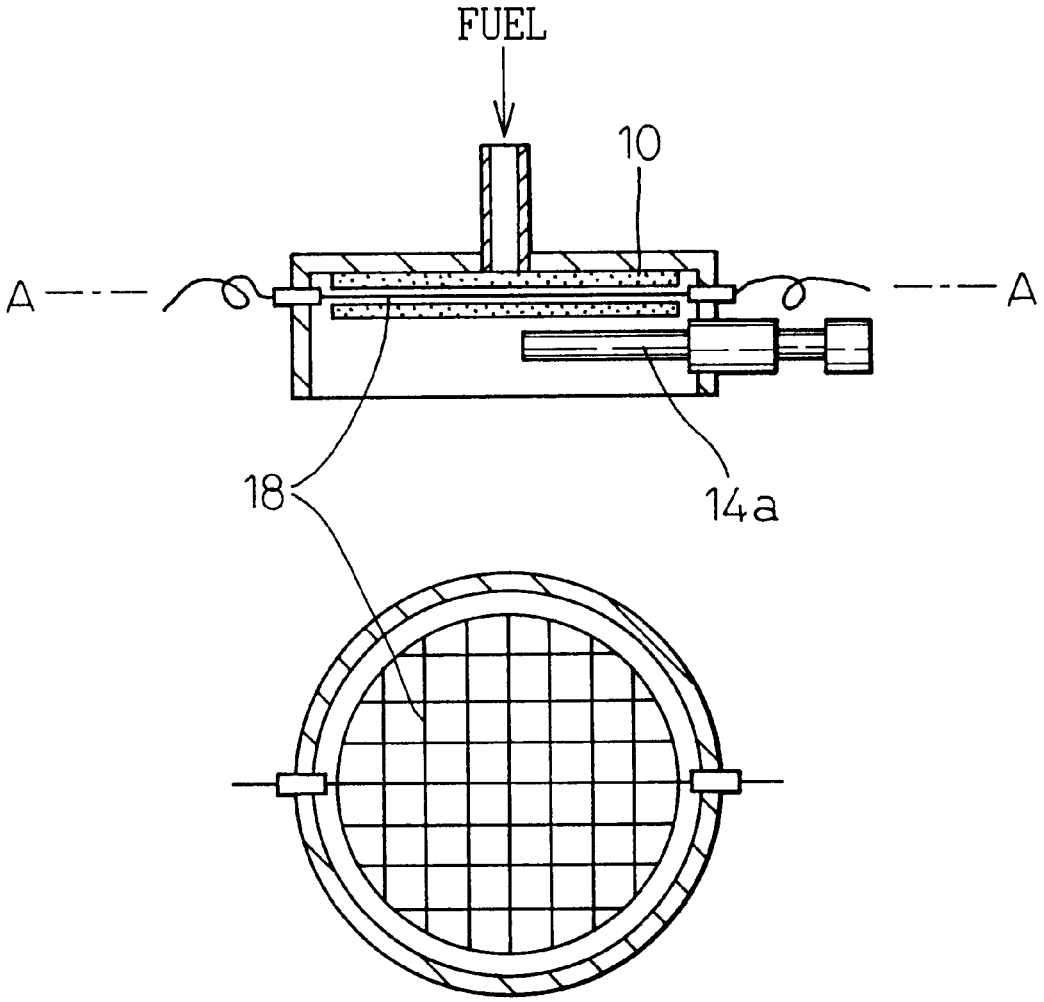
FIG. 7 is a schematic view showing a form where a planar heater is provided to a wick according to the third embodiment of the present invention.
Figure 8:
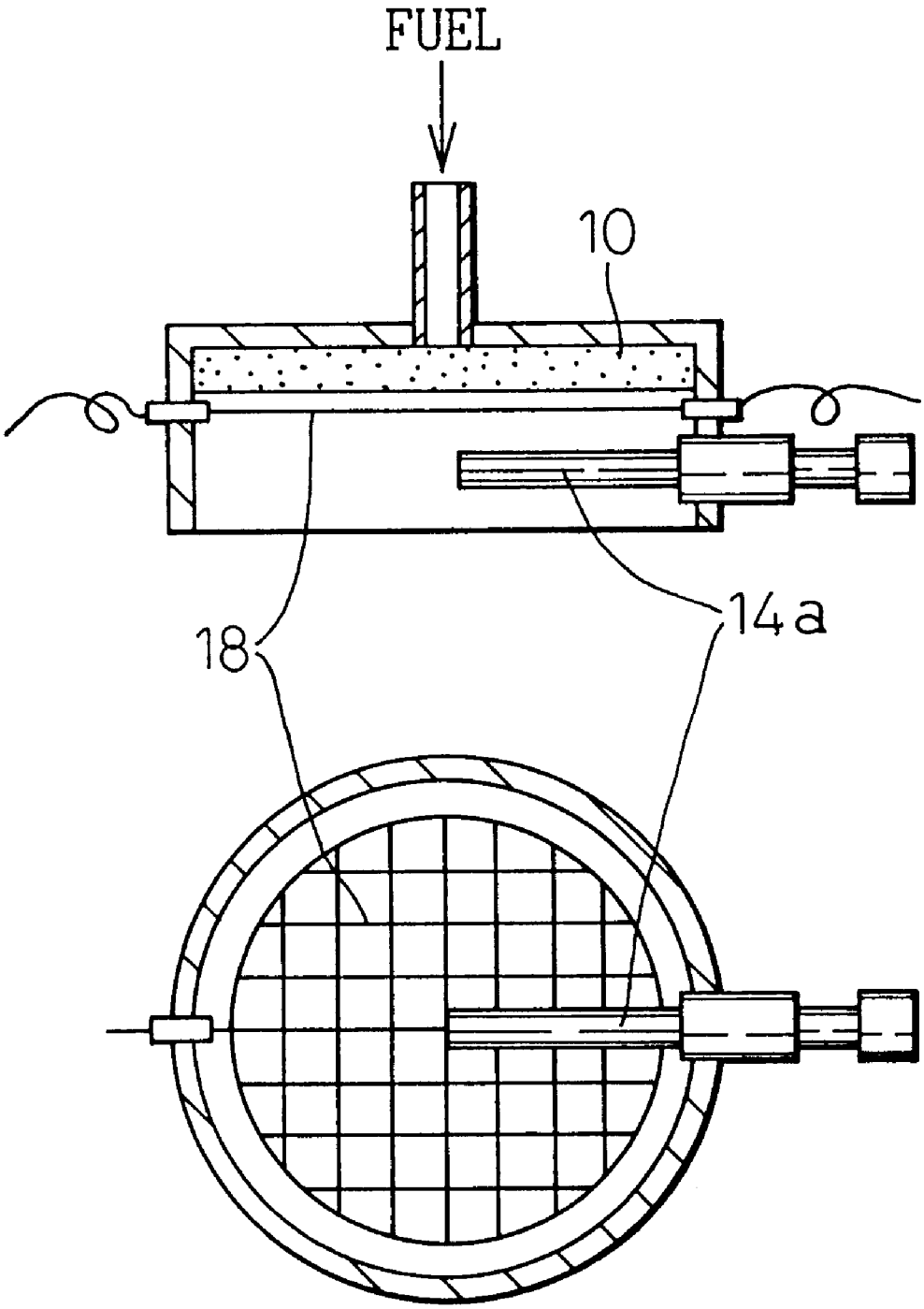
FIG. 8 is a schematic view showing another form where a planar heater is provided to the wick according to the third embodiment.

In the third embodiment of the present invention, a planar heater 18 is disposed in such a manner as to keep contact with the wick 10 as shown in FIGS. 7 and 8. The planar heater 18 may be buried into the wick 10 as shown in FIG. 7, or may be so disposed as to keep contact with the front surface of the wick 10 as shown in FIG. 8. The planar heater 18 comprises a wire material, for example, and uses electricity for heating. In this case, only one ignition glow plug 14*a* may suffice for the glow plug.

In the third embodiment, the planar heater 18 can efficiently heat the whole surface of the wick 10. Therefore, ignition generated by, and around, the ignition flow plug 14 quickly transfers to the fuel evaporating from the whole surface of the wick, so that combustion starts over the whole surface of the wick.

Figure 9:
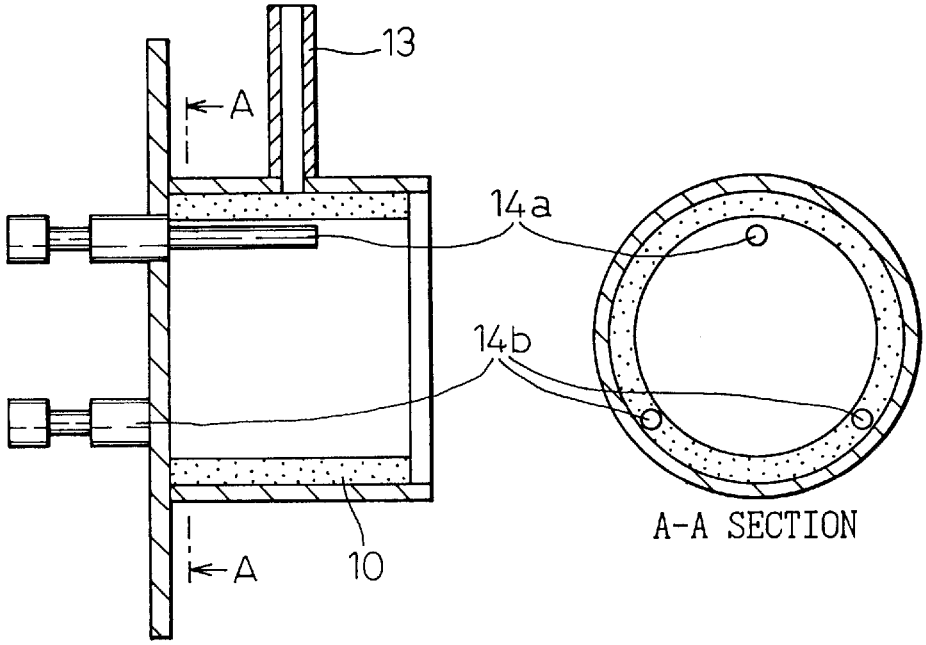
FIG. 9 is a schematic view showing a form of the arrangement of a glow plug for heating a cylindrical wick when the cylindrical wick is used according to the fourth embodiment of the present invention.
Figure 10:
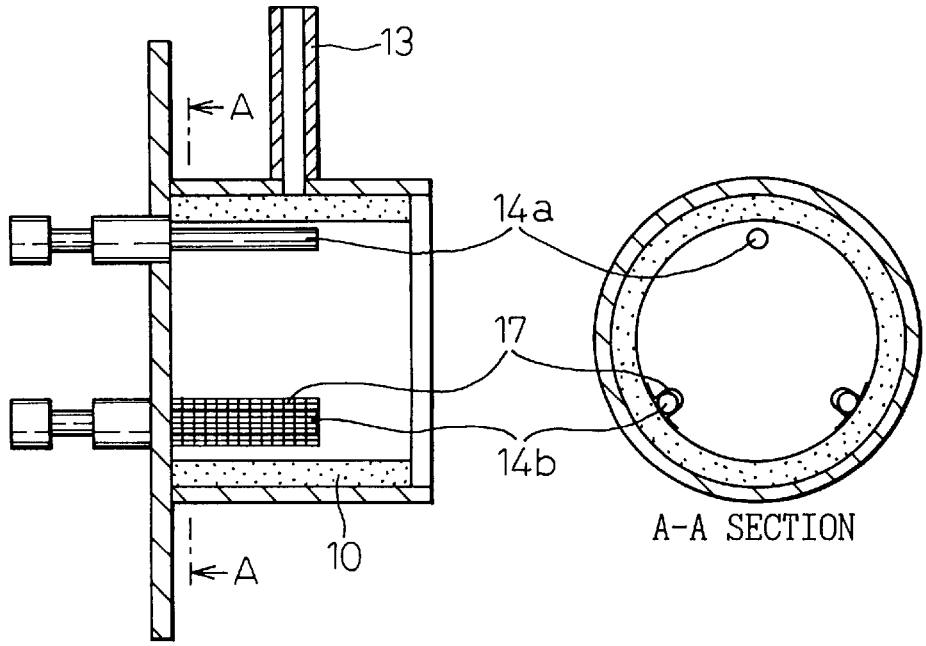
FIG. 10 is a schematic view showing another form of the arrangement of the glow plug for heating the wick when the cylindrical wick is used according to the fourth embodiment.

The first to third embodiments use the disc-like wick, but the fourth embodiment of the present invention uses a cylindrical wick 10 as shown in FIGS. 9 and 10. In this case, the fuel piping 13 is connected to the peripheral side surface of the casing 12, and the fuel is supplied to the center part of the peripheral side surface of the cylindrical wick 10. Referring to FIG. 9, the ignition glow plug 14*a* is disposed in parallel with the axial direction of the cylindrical wick 10 in the proximity of the inner peripheral surface of the wick 10, and two wick heating glow plugs 14*b* are buried into the wick 10 in the same direction. FIG. 10 shows the arrangement wherein the wick heating glow plug 14*b* is not buried into the wick 10 but is disposed on the inner peripheral surface of the wick 10 in such a manner as to keep contact with the inner peripheral surface in the axial direction. A heat transfer member 17 of a metal net is further disposed in such a manner as to cover the wick heating glow plug 14*b*.

The fourth embodiment, too, can exhibit a function and an effect similar to that of the embodiment shown in FIGS. 3 and 4.

In the first embodiment described above, it is effective to dispose the fuel distribution means 11 when the combustion chamber of the combustion type heater is disposed vertically, that is, in the longitudinal direction. The construction of the fifth embodiment is particularly suitable for a combustion type heater wherein the combustion chamber is disposed in the transverse direction as shown in FIG. 11.

Figure 11:
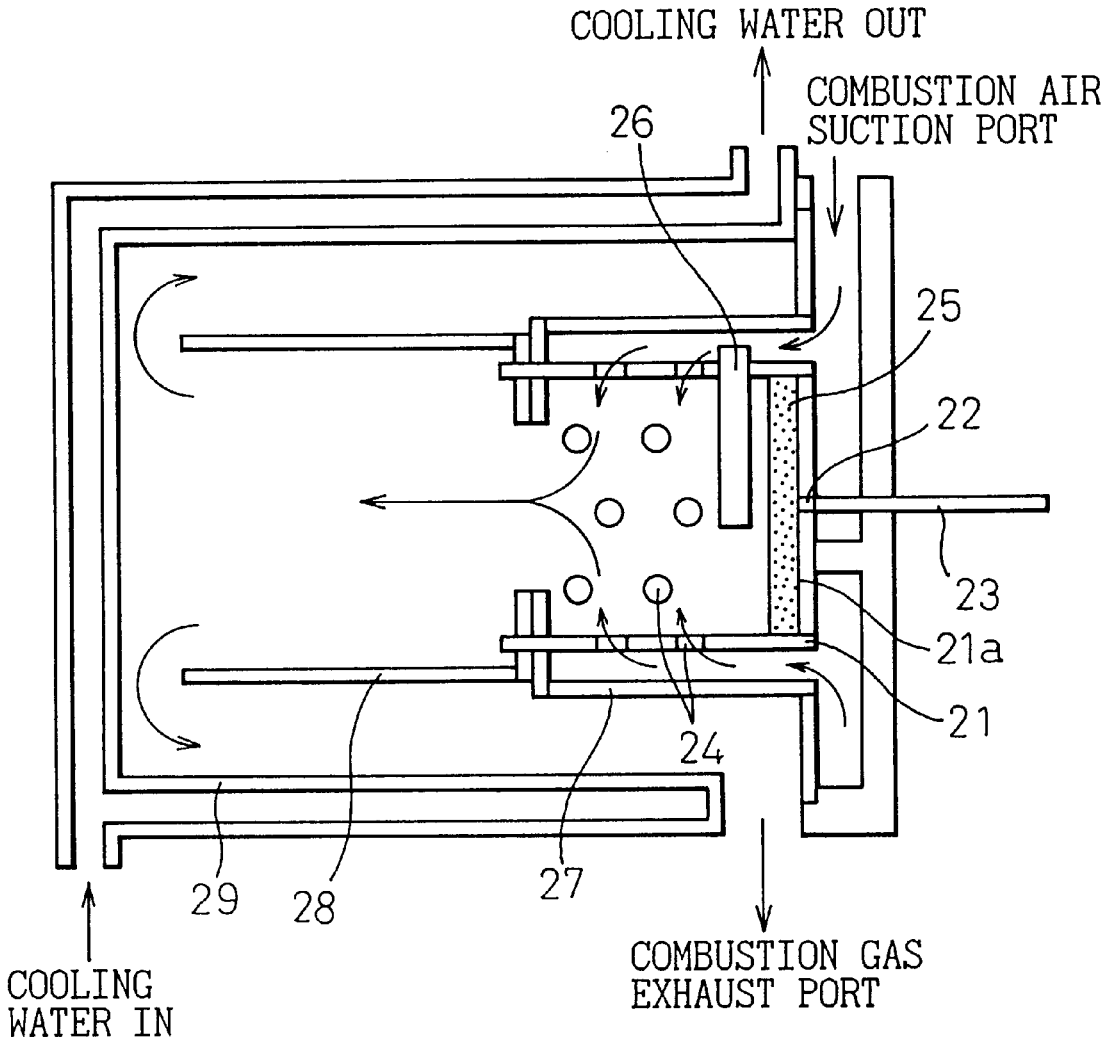
FIG. 11 is a sectional view showing an overall construction of a combustion type heater when a combustion chamber is disposed in a transverse direction.

The combustion type heater shown in FIG. 11 has a known construction. Though its detailed explanation is hereby omitted, the construction of the principal portions will be explained briefly. One of the ends of the cylindrical combustion chamber 21 that is arranged in the transverse direction inside the combustion type heater 20 is open with the other end being closed. A fuel feed port 22 is bored at a substantial center of the combustion chamber 21 and is connected to a fuel feed pipe 23. A large number of holes 24 are bored in the side surface of the combustion chamber 21 to suck combustion air. A wick 25 is so disposed as to keep contact with the bottom surface 21*a* as the closed end of the combustion chamber 21, and an ignition glow plug 26 is fitted to the side surface of the combustion chamber 21.

A cylindrical combustion air guide cylinder 27 is disposed in such a manner as to encompass the combustion chamber. Combustion air sucked from the side of the bottom portion of the combustion chamber 21 is guided into the guide cylinder 27, then passes through a large number of holes 24 in the side surface of the combustion chamber and is introduced into the combustion chamber 21. A cylindrical combustion cylinder 28 is connected to the open end of the combustion chamber 21. A casing 29, through which cooling water flows, is disposed in such a manner as to cover the combustion chamber 21 and the combustion cylinder 27. Therefore, the combustion gas and cooling water are subjected to heat exchange through the wall of the casing 29.

Figure 12:
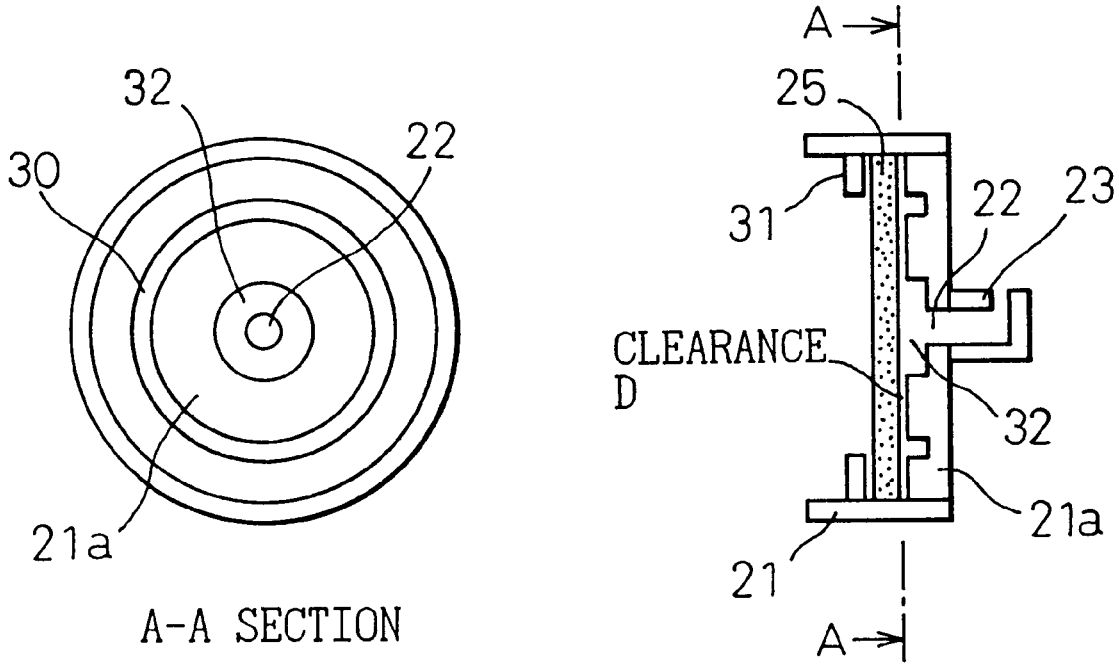
FIG. 12 is a partial sectional view and a plan view when a ring-like groove is formed in the bottom surface of a combustion chamber keeping contact with a wick according to the fifth embodiment of the present invention.

In the fifth embodiment of the present invention, ring-like grooves 30 are formed on the bottom surface 21*a* as the closed end of the combustion chamber 21 of the combustion type heater 21 as shown in FIG. 12. The ring-like groove 30 has a depth of about 0.1 to about 0.5 mm. The smaller the depth of the ring-like groove 30, the smaller becomes the heat capacity of the fuel and the better becomes the ignition property so long as the capillary action of the fuel to be described later is interrupted. In this case, the after-burn time at the time of put-off becomes shorter and the fuel cost can be saved. The ring-like groove 30 does not directly communicate with the fuel feed pipe 23. A wick 25 is so disposed as to keep contact with the bottom surface 21*a* of the combustion chamber 21 and is held by a ring-like holding plate 31. The wick 25 may be made of a porous material, but is preferably made of a metal fiber material so that heat conduction can be secured in a planar direction but not in the direction of thickness, the temperature can be averaged on the whole surface of the wick, and evaporation of the fuel can be attained uniformly. FIG. 13 depicts a clearance D between the wick 25 and the bottom surface 21*a*. However, this clearance D is practically an extremely small clearance that is generated by the mere contact between different kinds of materials. In the embodiment shown in FIG. 12, a circular recess 32 that is connected to the fuel feed port 22 and has a diameter greater than that of the feed port 22 is shown formed in the bottom surface 21*a* of the combustion chamber 21 besides the ring-like groove 30.

Figure 13B:
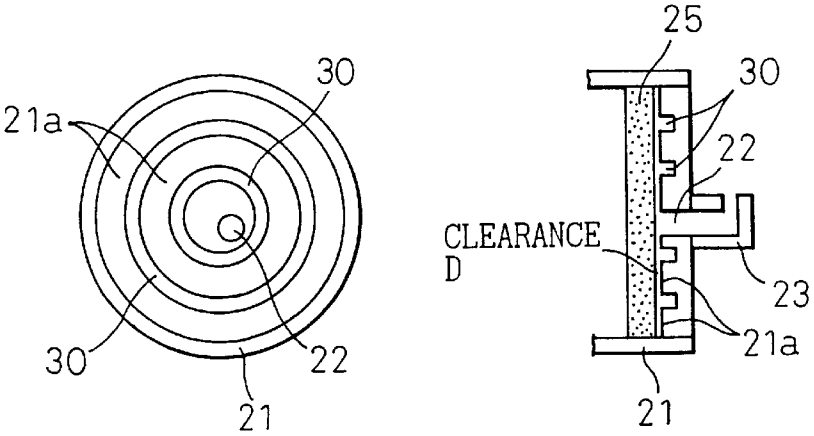
FIGS. 13A, 13B and 13C are schematic views useful for explaining three modified embodiments of the fifth embodiment, respectively.
Figure 13A:
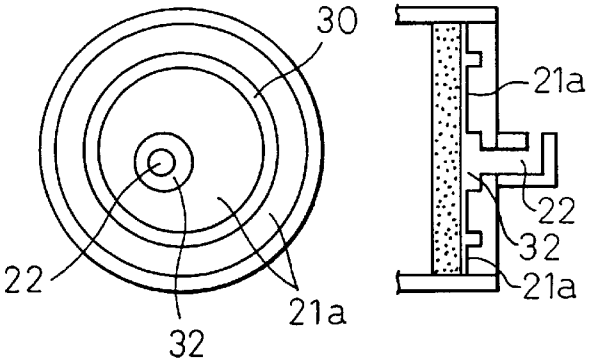
Figure 13C:
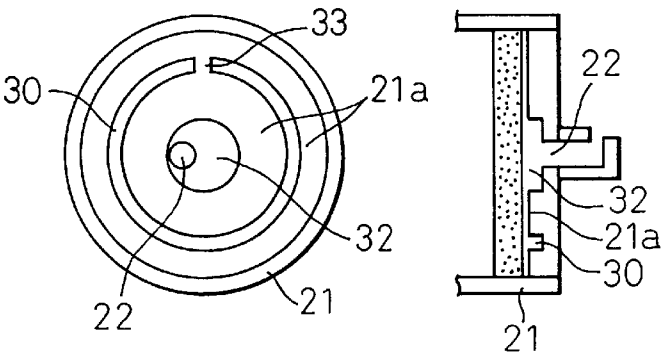

FIGS. 13A, 13B and 13C show modified embodiments of the fifth embodiment of the present invention. In the modified embodiment shown in FIG. 13A, the fuel feed port 22 and the circular recess 32 round the fuel feed port 22 are formed at positions deviated from the center of the bottom surface 21*a* of the combustion chamber. This modified embodiment is suitable when it is difficult to position the fuel feed pipe 23 at the center of the bottom surface 21*a* of the combustion chamber for reasons of installation of the combustion heater.

In the modified embodiment shown in FIG. 13B, two, large and small, ring-like grooves 30 are formed. In this modified embodiment, the circular recess 32 adjacent to the fuel feed port 22 is not disposed. Instead, a plurality of ring-like grooves 30 is disposed to further promote diffusion of the fuel.

In the modified embodiment shown in FIG. 13C, the ring-like groove 30 does not define a complete circle but a part of the ring-like groove 30 is cut off to form a non-connection part 33. In this case, it is essentially necessary to position this non-connection part 33 at the upper position. Since the upper part of the ring-like groove 30 does not much contribute to-diffusion of the fuel, a sufficient fuel diffusion effect can be expected even when the non-connection part 33 is positioned at the upper position.

Figure 14:
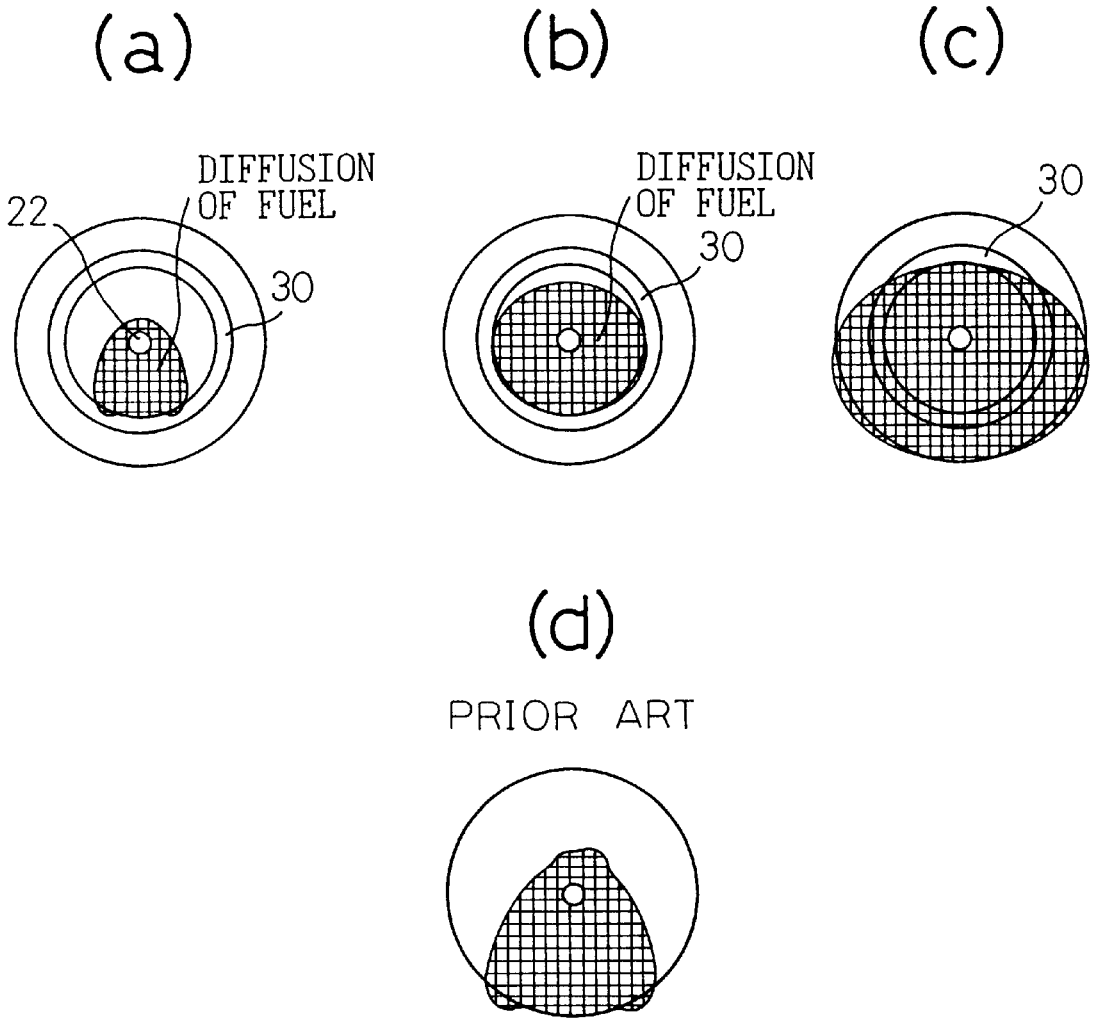
FIG. 14 is a schematic view useful for explaining a fuel diffusion state (a), (b) and (c) in the fifth embodiment in comparison with a fuel diffusion state (d) in a prior art technology.

FIG. 14 shows the diffusion state of the fuel when the ring-like groove 30 is defined in the bottom surface 21*a* of the combustion chamber in the fifth embodiment of the present invention in comparison with a prior art example where the ring-like groove is not disposed. The liquid fuel entering from the fuel feed port 22 includes the fuel that sinks into the wick 25 and the fuel that passes through the extremely small clearance D between the wick 25 and the bottom surface 21*a* of the combustion chamber. The fuel flowing through the very small clearance D, due to a capillary action, flows down more easily due to the weight of the fuel. FIG. 14(*a*) shows this state.

Next, when the fuel reaches the ring-like groove 30 of the bottom surface 21*a* of the combustion chamber, surface tension develops. As this surface tension holds the fuel, the fuel moves to the side surface and to the upper portion along the ring-like groove 30. FIG. 14(*b*) shows this state. As a result, the fuel diffuses substantially to the whole surface of the wick 25 as shown in FIG. 14(*b*) and is burnt satisfactorily without leaking to the lower portion of the combustion chamber. As described above, this embodiment disposes the ringlike groove 30 in the bottom surface 21*a* of the combustion chamber, utilizes the fuel holding operation by the surface tension of the fuel, and can diffuse the fuel.

In contrast, FIG. 14(*d*) shows the fuel diffusion state in the prior art where the ring-like groove is not disposed. The fuel does not diffuse to the whole surface of the wick 25 but stays at the lower portion of the combustion chamber.

Incidentally, the present invention has thus been explained about its preferred first to fifth embodiments with reference to FIGS. 1 to 14 for improving the rise time of the operation of the combustion type heater. Needless to say, however, these first to fifth embodiments can be utilized in suitable combinations with one another.

The peripheral wall of the combustion chamber at the fitting portion of the glow plug or plugs can of course be recessed lest the-head of the glow plug protrudes outward from the outer circumferential circle of the combustion chamber.

As explained above, the combustion type heater according to the present invention can effectively diffuse the fuel into the wick as a whole and can quicken the heating time of the wick itself and the start time of the combustion type heater. Since the mixing ratio of the fuel and the combustion air can be made uniform throughout the whole wick surface, combustion is attained satisfactorily and exhaust emission can be improved.

While the present invention has been described by reference to specific embodiments chosen for purposes of illustration, it should be apparent that numerous modifications could be made thereto, by those skilled in the art, without departing from the basic concept and scope of the invention.

What is claimed is:

1. A combustion type heater including a combustion chamber, an air feed mechanism for feeding combustion air to said combustion chamber, a fuel feed mechanism for feeding a fuel to said combustion chamber and a heat exchange part for conducting heat exchange between a combustion exhaust gas and a heat exchange fluid, said heater comprising:

a wick disposed inside said combustion chamber; and fuel distribution means disposed in a fuel passage upstream of said wick for distributing the fuel from said fuel feed mechanism to the whole surface of said wick, said fuel distribution means comprising a distribution groove formed in an inner surface of a bottom of the combustion chamber, said fuel distribution groove distributing the fuel from the fuel feed mechanism to the entire surface of the wick by moving the fuel in an upper and sides directions along the groove due to a fuel holding operation by the surface tension of the fuel.

2. A combustion type heater including a combustion chamber, an air feed mechanism for feeding combustion air to said combustion chamber, a fuel feed mechanism for feeding a fuel to said combustion chamber and a heat exchange part for conducting heat exchange between a combustion exhaust gas and a heat exchange fluid, said heater comprising:

a wick disposed inside said combustion chamber; and fuel distribution means disposed in a fuel passage upstream of said wick, for distributing the fuel from said fuel feed mechanism to the whole surface of said wick;

wherein said fuel distribution means comprises a large number of fuel distribution grooves so defined as to extend radially from the center of a bottom of a casing for holding said wick inside said combustion chamber, and a flat sheet-like fuel dispersion plate having a large number of holes bored therein.

3. A combustion type heater including a combustion chamber, an air feed mechanism for feeding combustion air to said combustion chamber, a fuel feed mechanism for feeding a fuel to said combustion chamber and a heat exchange part for conducting heat exchange between a combustion exhaust gas and a heat exchange fluid, said heater comprising:

a wick disposed inside said combustion chamber;

fuel distribution means disposed in a fuel passage upstream of said wick, for distributing the fuel from said fuel feed mechanism to the whole surface of said wick; and a heat transfer member for covering said glow plug, a part of said heat transfer member keeping contact with said wick.

4. A combustion type heater according to claim 3, wherein said heat transfer member is a metal net.

5. A conduction type heater according to claim 3, wherein said heat transfer member is a heat transfer coil.

6. A combustion type heater according to claim 3, which further comprises fuel distribution means.

7. A combustion type heater including a combustion chamber, an air feed mechanism for feeding combustion air to said combustion chamber, a fuel feed mechanism for feeding a fuel to said combustion chamber and a heat exchange part for conducting heat exchange between a combustion exhaust gas and a heat exchange fluid, comprising:

a wick so disposed as to keep contact with a bottom surface of said combustion chamber; and ring-like grooves defined in the bottom surface of said combustion chamber in such a manner as to encompass a fuel feed port formed in the bottom surface of said combustion chamber, said ring like grooves distributing the fuel from the fuel feed mechanism to the entire surface of the wick by moving the fuel in an upper and sides directions along the ring like grooves due to a fuel holding operation by the surface tension of the fuel.

8. A combustion type heater according to claim 7, wherein a plurality of said ring-like grooves is disposed concentrically in the bottom surface of said combustion chamber.

9. A combustion type heater according to claim 1 wherein the fuel distribution groove has a depth of approximately 0.1 to approximately 0.5 mm.

* * * * *